United States Patent [19]

Anderson

[11] Patent Number: 5,024,357

[45] Date of Patent: Jun. 18, 1991

[54] LATCH HOOK FRAME

[76] Inventor: Thomas F. Anderson, Star Route Box 87-A, Leonardtown, Md. 20650

[21] Appl. No.: 509,848

[22] Filed: Apr. 17, 1990

[51] Int. Cl.[5] ..... A41H 5/00; A41H 31/00

[52] U.S. Cl. ..... 223/106; 223/107; 223/108; 223/120

[58] Field of Search ..... 223/120, 106, 107, 108; 38/102, 102.1, 102.3, 102.4, 102.6, 102.9, 102.91; 211/44, 45; 248/163, 371

[56] References Cited

U.S. PATENT DOCUMENTS

| | | | |
|---|---|---|---|
| 3,938,267 | 2/1976 | Bard | 38/102.1 |
| 3,955,722 | 5/1976 | Bard | 223/106 |
| 4,189,856 | 2/1980 | Cookson | 38/102.4 |
| 4,315,645 | 2/1982 | Kroy | 38/102.4 |
| 4,378,646 | 4/1983 | Mazeika | 38/102.4 |
| 4,501,080 | 2/1981 | Rich | 223/120 |
| 4,736,535 | 4/1988 | Rucker | 38/102.1 |
| 4,944,105 | 7/1990 | Schulle | 38/102 |

OTHER PUBLICATIONS

Shillcraft Catalog (p. 38).

*Primary Examiner*—Werner H. Schroeder
*Assistant Examiner*—Bibhu Mohanty
*Attorney, Agent, or Firm*—David B. Newman, Jr. & Associates

[57] ABSTRACT

A latch hook frame comprising a harp, a plurality of pegs, left and right tray supports and a tray, left and right legs and a main brace. The harp is characterized by a rectangular frame including a left member, a right member, three lateral members connected to the left member and to the right member, and a flat surface attached to the underside of the middle and front laterals. The plurality of pegs attach to the back lateral member of the harp and projecting therefrom, for holding the canvas. The left and right tray supports attach to the left and right members of the harp. The tray is connected pivotally to the left and right tray supports. The left and right legs are connected pivotally to the left and right members of the harp. The main brace connects to the left and right legs, and the left foot connects to left leg and the right foot connects to the right leg.

12 Claims, 1 Drawing Sheet

LATCH HOOK FRAME

BACKGROUND OF THE INVENTION

This invention relates to latch hook frames for users who hook yarn to a canvas, and more particularly to a latch hook frame which allows a user to better differentiate the colors printed on the canvas while hooking yarn.

DESCRIPTION OF THE PRIOR ART

In the prior art latch hook frames allow a user to stretch a canvas from hooks or dowels projecting from a rear part of the frame, with the canvas projecting over a front part of the frame. Typically, the canvas is stretched over an empty space.

In one embodiment of a prior art latch hook frame, a tray was provided above the frame for holding yarn. The dowels or pegs projecting from the rear of a latch hook frame keep the canvas and fabric taught and easy to work with.

OBJECTS AND SUMMARY OF THE INVENTION

An object of the present invention is to provide a latch hook frame which is easy to assemble and use.

Another object of the present invention is to provide a latch hook frame with a plurality of pegs for keeping a canvas taught.

A further object of the present invention is to provide a latch hook frame having a flat white surface so that a user can see the pattern imprinted on the canvas against the flat surface, and thereby better differentiate the colors imprinted thereon.

A still further object of the present invention is to provide a latch hook frame having a two-part tray for holding full packs of yarn, individual strands of yarn, the latchhooking tool, etc., in an organized manner. Further, the ledge created by the attachment of the white vinyl material to the underside of the bottom of the middle and front lateral members of the harp, creates a handy catch-basin for the tiny pieces of yarn (fuzzies) which are always generated and accumulate as a result of pushing each strand through the holes in the canvas. From this catch area they are easily pinched up or swept into a waiting hand at either end where the white material is purposely cut short to allow the fuzzies to drop through.

According to the present invention, as embodied and broadly described herein, a latch hook frame is provided comprising a harp, a plurality of pegs, left and right tray supports, a tray, left and right legs, and left and right feet. The harp has a rectangular frame having a left member, a right member, back, middle and front lateral members and a flat surface. The back lateral member is connected to the rear end of the left member and to the rear end of the right member. The flat surface is connected to the underside of the middle and front lateral members which are also connected to left and right members.

The plurality of pegs attach to the back member of the harp and project therefrom for holding a canvas. Left and right tray supports attach near the rear end of the left and right members of the harp, respectively. The tray connects pivotally to the left and right tray supports.

The left and right legs connect pivotally to the left and right members of the harp. Multiple holes at the top of each leg allow for overall height adjustment of the harp from the floor. A main brace to provide frame rigidity is connected to the left and right legs. The left foot connects to the left leg for supporting the left leg perpendicular to the left foot, and the right foot connects to the right leg for support of the right leg perpendicular to the right foot.

In use, the harp pivotally adjusts at an angle position for allowing a user to hook yarn to a canvas and to view the canvas against the flat white surface of the harp. The tray pivotally adjusts to a horizontal position.

Additional objects and advantages will be set forth in part in the description which follows, and in part will be obvious from the description, or may be learned by practice of the invention. The objects and advantages of the invention also may be realized and obtained by means of the instrumentalities and combinations particularly pointed out in the appended claims.

BRIEF DESCRIPTION OF THE DRAWINGS

The accompanying drawings, which are incorporated in and constitute a part of this specification, illustrate particular embodiments of the invention, and together with the description, serve to explain the principles of the invention.

DETAILED DESCRIPTION OF THE PREFERRED EMBODIMENTS

Reference will now be made in detail to the present preferred embodiments of the present invention, examples of which are illustrated in the accompanying drawings.

Figure 1:
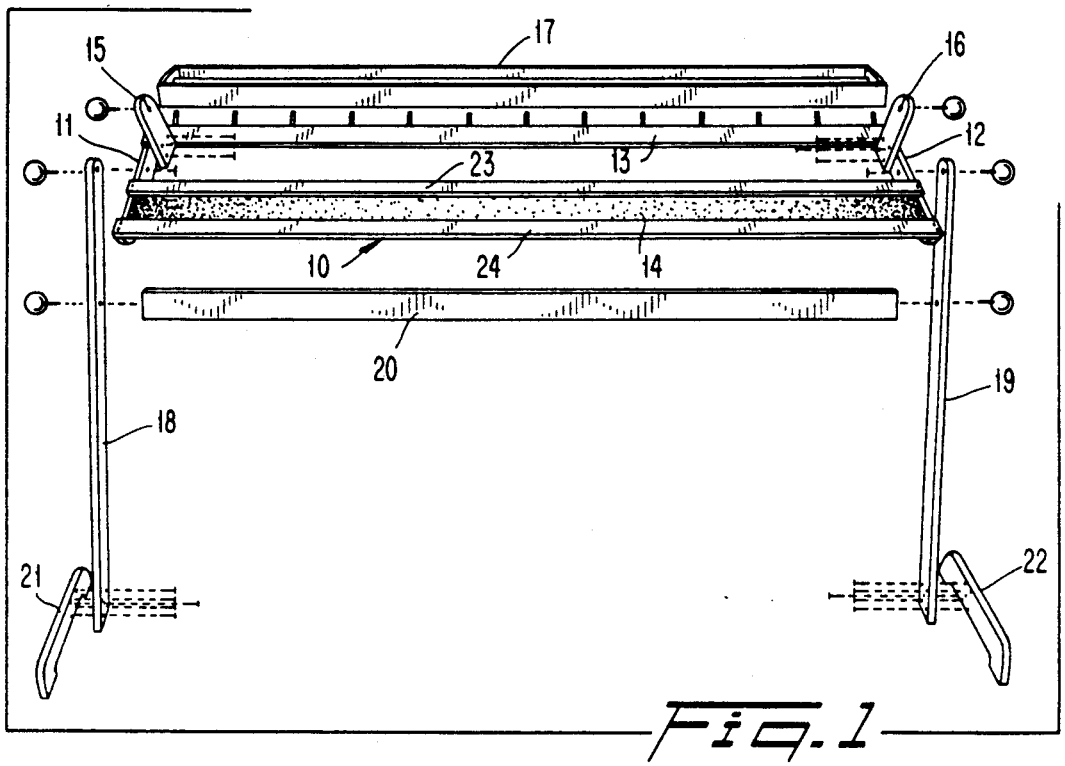
FIG. 1 is a frontal view of the latch hook frame of the present invention in a disassembled form.

Referring to FIG. 1, a preferred embodiment of the latch hook frame is shown, comprising a harp 10, left supporting means and right supporting means. The left and right supporting means are connected to the harp 10 for supporting the harp 10. The left supporting means may include a left leg 18 connected to the harp 10, and a left foot 21 connected to the left leg 18. The right supporting means may include a right leg 19, connected to the harp 10, and a right foot 22 connected to the right leg 19.

The present invention further includes a plurality of pegs 25, a left tray support 15, a right tray support 16, a tray 117, and a main brace 20.

The harp 10 is has a rectangular frame including a left member 11, a right member 12, a back lateral member 13, and middle and front lateral members 23, 24 supporting a flat surface 14. The back lateral member 13 is connected to a rear end of the left member 11 and to a rear end of the right member 12. The middle and front lateral members 23, 24 supporting the flat surface 14 are connected to a front end of the left member 11 and to a front end of the right member 12.

A plurality of pegs 25 is attached to the back member 13 of the harp 10 and project therefrom. The plurality of pegs 25 is for holding a canvas.

The left tray support 15 attaches near the rear end of the left member 11 of the harp 10. The right tray support 16 attaches near the end of the right member 12 of the harp 10. The tray 17 pivotally connects to the left tray support 15 and pivotally connects to the right tray support 16. The left and right tray supports 15, 16 may connect to the tray 17 using ball knobs, as shown.

The left leg 18 is pivotally connected to the left member 11 of the harp 10. The right leg 19 is pivotally connected to the right member 12 of the harp 10. The main brace 20 is connected to the left leg 18 and to the right leg 19. The left and right legs 18, 19 may connect to the harp 10 and main brace 20 using ball knobs, as shown.

The left foot 21 is connected to the left leg 18 for supporting the left leg 18 perpendicular to the left foot 21. The right foot 22 is connected to the right leg 19 for supporting the right leg 19 perpendicular to the right foot 22.

In use, the harp 10 pivotally adjusts at an angle position for allowing a user hooking yarn to place it in whatever position is most comfortable. The tray 17 pivotally adjusts to a horizontal position.

Figure 2:
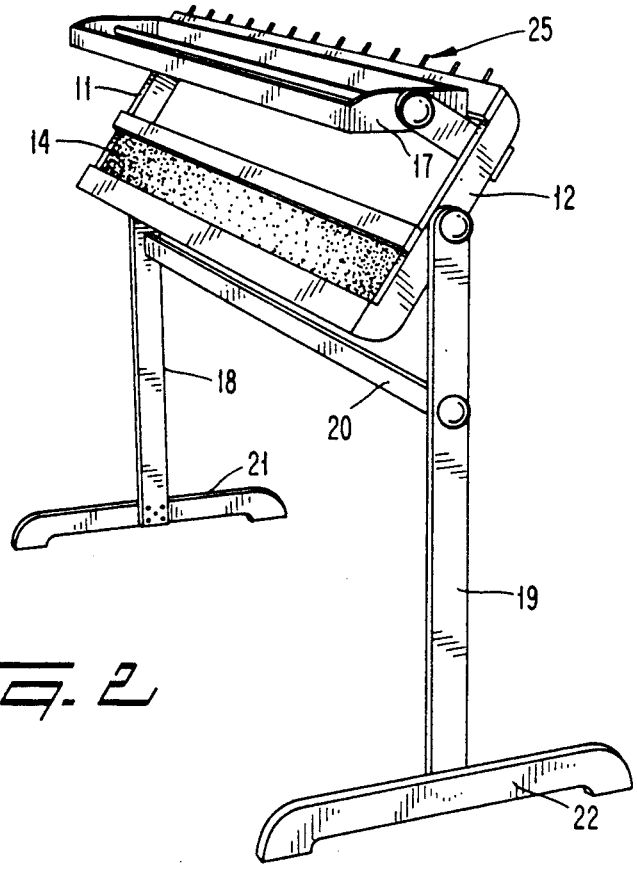
FIG. 2 is an oblique view of the latch hook frame of the present invention.

FIG. 2 illustrates an oblique view of the latch hook frame of the present invention. As shown in FIG. 2, the harp 10 is adjusted at an angle position for allowing a user hooking yarn to view the canvas against the flat surface 14 of the harp 10. The tray 17 is pivotally adjusted to a horizontal position.

The latch hook frame of the present invention may be shipped in a disassembled form and readily assembled. In a preferred embodiment, the flat surface 14 may include a three or four inch white area making it easier to differentiate between colors of yarn which are being hooked into a canvas. Additionally, the white flat surface 14 has an advantage that little fuzzies that accumulate will gather conveniently at the bottom of the flat surface 14 where they easily can be pinched up or brushed off into a waiting hand at either end of the white flat surface 14.

The tray 17 is designed to hold complete packs of yarn in the back section and loose strands and hooks etc., in the front section. The tray 17 is easily removed and replaced so that one can take the tray 17 to the yarn if that is more convenient.

At the end of a canvas when it is no longer possible to work over the white background areas of the white flat surface 14, one may switch the frame around and hang the rug from the back side. Simply turning the tray 17 around and one is back in business hooking the canvas. One will not have the white background anymore in this position, but for the last rows one should not have a problem.

In general use, a user hooks the canvas to the pegs 25 projecting from the rear member 13 of the harp, and drapes the canvas over the flat surface 14. The flat white surface 14 allows one to see the canvas, and yarn which is being hooked into the canvas. The tray 17 typically has two compartments, a first compartment, and a second compartment. The first compartment which may be in the rear part of the tray 17 could be used for holding yarn. The second compartment which may be in the front portion of the tray 17 can be used for holding hooks, individual strands of yarn, and other small items.

The tray 17 may be readily attached and detached using ball knobs as shown in FIG. 1. Indeed, the entire latch hook frame may be assembled and disassembled using the ball knobs.

It will be apparent to those skilled in the art that various modifications can be made to the latch hook frame of the instant invention without department from the scope or spirit of the invention, and it is intended that the present invention cover modifications and variations of the latch hook frame provided they come within the scope of the appended claims and their equivalents.

I claim:

1. A latch hook frame comprising:

a harp having a rectangular frame including a left member, a right member, back, middle and front lateral members connected to said left member and right member, and a flat surface attached to the underside of the middle and front lateral members;

a plurality of pegs attached to said back lateral member of said harp and projecting therefrom, for holding canvas;

a left tray support attached near the rear end of said left member of said harp;

a right tray support attached near the rear end of said right member of said harp;

a tray pivotally connected to said left tray support and pivotally connected to said right tray support;

a left leg pivotally connected to said left member of said harp;

a right leg pivotally connected to said right member of said harp;

a main brace connected to said left leg and to said right leg;

a left foot connected to said left leg for supporting said left leg perpendicular to said left foot;

a right foot connected to said right leg for supporting said right leg perpendicular to said right foot; and wherein said harp pivotally adjusts at an angle position for allowing a user hooking yarn to a canvas to view said canvas against said flat surface of said harp, and said tray pivotally adjusts to a horizontal position.

2. A latch hook frame comprising:

a harp having a rectangular frame including a left member, right member, back, middle and front lateral members connected to said left member and to said right member, and a surface connected to the underside of said middle and front lateral members;

a left leg connected to said left member of said harp; and a right leg connected to said right member of said harp.

3. The latch hook frame as set forth in claim 2, further including:

a main brace connected to said left leg and to said right leg.

4. The latch hook frame as set forth in claim 2, further including:

a plurality of pegs attached to said back member of said harp and projecting therefrom, for holding a canvas.

5. The latch hook frame as set forth in claim 2, further including:

a left tray support attached near the rear end of said left member of said harp;

a right tray support attached near the rear end of said right member of said harp; and a tray pivotally connected to said left tray support and pivotally connected to said right tray support.

6. The latch hook frame as set forth in claim 5, wherein said harp pivotally adjusts at an angle position for allowing auser hooking yarn to a canvas to view said canvas against said flat surface of said harp, and said tray pivotally adjusts to a horizontal position.

7. The latch hook frame as set forth in claim 2, further including:

a left foot connected to said left leg for supporting said left leg perpendicular to said left foot; and a right foot connected to said right leg for supporting said right leg perpendicular to said right foot.

8. A latch hook frame comprising:

a harp having a rectangular frame including a left member, a right a back lateral member connected to a rear end of said left member and to a rear end of said right member, middle and front lateral members connected near a front of said left and right members, and a flat surface attached to the underside of said middle and front and lateral members;

left means connected to said harp for supporting said harp; and right means connected to said harp for supporting said harp.

9. The latch hook frame as set forth in claim 8, wherein said left means includes a left leg connected to said harp and a left foot connected to said left leg; and said right means includes a right leg connected to said harp and a right foot connected to said right leg.

10. The latch hook frame as set forth in claim 8, further including:

a plurality of pegs attached to said back member of said harp and projecting therefrom, for holding a canvas.

11. The latch hook frame as set forth in claim 8, further including:

a left tray support attached near the rear end of said left member of said harp;

a right tray support attached near the rear end of said right member of said harp; and a tray pivotally connected to said left tray support and pivotally connected to said right tray support.

12. The latch hook frame as set forth in claim 11, wherein said harp pivotally adjusts at an angle position for allowing a user hooking yarn to a canvas to view said canvas against said flat surface of said harp, and said tray pivotally adjusts to a horizontal position.

* * * * *